US011253745B2

(12) United States Patent
Spelman

(10) Patent No.: US 11,253,745 B2
(45) Date of Patent: Feb. 22, 2022

(54) ARM CHAIR EXERCISE APPARATUS

(71) Applicant: Balanced Body, Inc., Sacramento, CA (US)

(72) Inventor: Kit W. Spelman, Elk Grove, CA (US)

(73) Assignee: BALANCED BODY, INC., Sacramento, CA (US)

( * ) Notice: Subject to any disclaimer, the term of this patent is extended or adjusted under 35 U.S.C. 154(b) by 0 days.

(21) Appl. No.: 17/064,420

(22) Filed: Oct. 6, 2020

(65) Prior Publication Data

US 2021/0121739 A1 Apr. 29, 2021

Related U.S. Application Data

(60) Provisional application No. 62/925,164, filed on Oct. 23, 2019.

(51) Int. Cl.
*A63B 23/12* (2006.01)
*A63B 21/04* (2006.01)
(Continued)

(52) U.S. Cl.
CPC ..... *A63B 23/12* (2013.01); *A63B 21/0442* (2013.01); *A63B 21/0557* (2013.01);
(Continued)

(58) Field of Classification Search
CPC ..... A63B 21/00; A63B 21/00043; A63B 21/00047; A63B 21/00058; A63B 21/00061; A63B 21/00065; A63B 21/00069; A63B 21/00181; A63B 21/00185; A63B 21/02; A63B 21/022; A63B 21/023; A63B 21/025; A63B 21/04; A63B 21/0407; A63B 21/0414; A63B 21/0421; A63B 21/0428; A63B 21/0442; A63B 21/06; A63B 21/062; A63B 21/0622; A63B 21/0624; A63B 21/068; A63B 21/078; A63B 21/0783; A63B 21/16;
(Continued)

(56) References Cited

U.S. PATENT DOCUMENTS 5,599,261 A 2/1997 Easley et al.
6,605,022 B2 8/2003 Webber
(Continued)

OTHER PUBLICATIONS

International Search Report and Written Opinion, dated Jan. 21, 2021, from corresponding International Patent App. No. PCT/US2020/054426.

*Primary Examiner* — Megan Anderson
*Assistant Examiner* — Thao N Do
(74) *Attorney, Agent, or Firm* — Greenberg Traurig, LLP

(57) ABSTRACT

A chair arm exercise apparatus includes three distinct back positions with hand resistance members such as springs supported from a pair of supports spaced from the upper end of the back. The arm chair includes a base configured to rest on a horizontal floor surface, a seat, a pair of spaced apart trapezoidal shaped upright frame sides, a front upright end wall beneath and supporting a front end of the seat, a seat back pivotally supported from the frame sides behind the seat, and a seat cross member beneath the rear edge of the seat fastened to the frame sides. In a first position the back is at about 90 degrees to the seat. In a second position the back is about 80 degrees to the seat. In the third position the back is reclined.

19 Claims, 9 Drawing Sheets

(51) Int. Cl.
*A63B 21/16* (2006.01)
*A63B 22/00* (2006.01)
*A63B 21/055* (2006.01)

(52) U.S. Cl.
CPC ..... *A63B 21/1609* (2015.10); *A63B 22/0002* (2013.01); *A63B 2208/0233* (2013.01)

(58) Field of Classification Search
CPC ..... A63B 21/1609; A63B 21/1672; A63B 21/1681; A63B 21/169; A63B 21/4017; A63B 21/4021; A63B 21/4023; A63B 21/4027; A63B 21/4029; A63B 21/4031; A63B 21/4033; A63B 21/4034; A63B 21/4035; A63B 21/4041; A63B 21/4043; A63B 21/4045; A63B 21/4047; A63B 21/4049; A63B 22/00; A63B 22/0002; A63B 22/0005; A63B 22/001; A63B 22/0012; A63B 22/0015; A63B 23/00; A63B 23/035; A63B 23/03508; A63B 23/03516; A63B 23/03533; A63B 23/03541; A63B 23/0355; A63B 23/03558; A63B 23/03566; A63B 23/03575; A63B 23/12; A63B 23/1209; A47C 9/002; A47C 9/005; A47C 13/00; A47C 13/005; A47C 15/00; A47C 15/002; A47C 15/004
USPC ..... 482/121; 297/301.5
See application file for complete search history.

(56) References Cited

U.S. PATENT DOCUMENTS 7,118,172 B1 * 10/2006 Pattison-Sheets ..... A47C 7/66 297/129
7,125,368 B2 * 10/2006 Endelman ..... A63B 21/055 482/142
7,163,500 B2 * 1/2007 Endelman ..... A63B 21/04 482/139
7,654,944 B1 * 2/2010 Liu ..... A63B 21/4029 482/142
7,850,586 B2 12/2010 Verheem
7,981,011 B1 * 7/2011 Batca ..... A63B 23/1209 482/100
11,065,495 B1 * 7/2021 Savarino ..... A63B 21/0428
2003/0050156 A1 3/2003 Tornabene
2004/0152572 A1 * 8/2004 Reitz ..... A63B 21/1609 482/140
2005/0032614 A1 * 2/2005 Keiser ..... A63B 21/4029 482/142
2005/0148449 A1 * 7/2005 Weir ..... A63B 21/078 482/142
2006/0025289 A1 * 2/2006 Wallach ..... A63B 21/4035 482/121
2006/0035772 A1 * 2/2006 Golesh ..... A63B 21/4031 482/142
2006/0040810 A1 * 2/2006 Chu ..... A63B 21/068 482/142
2006/0122045 A1 * 6/2006 Webber ..... A63B 21/4029 482/142
2006/0148625 A1 * 7/2006 Garner ..... A63B 21/00 482/123
2006/0284451 A1 * 12/2006 Hoffman ..... A47C 13/00 297/17
2007/0111861 A1 * 5/2007 Nativ ..... A63B 23/04 482/51
2007/0111869 A1 * 5/2007 Wallach ..... A63B 23/03525 482/129
2007/0155604 A1 * 7/2007 Hockemeyer ..... A63B 21/4029 482/142
2008/0004166 A1 * 1/2008 Oren ..... A63B 23/03508 482/142
2008/0051274 A1 * 2/2008 Greene ..... A63B 23/0222 482/142
2009/0036274 A1 * 2/2009 Greene ..... A63B 23/0222 482/57
2010/0109386 A1 * 5/2010 Hensley ..... A47C 4/52 297/46
2011/0140484 A1 * 6/2011 Chang ..... A47C 9/002 297/118
2013/0020840 A1 * 1/2013 Berginc ..... A47C 13/00 297/118
2013/0157818 A1 * 6/2013 Lalaoua ..... A63B 23/035 482/123
2013/0157824 A1 * 6/2013 Chen ..... A63B 21/0555 482/142
2015/0165259 A1 * 6/2015 Huppee ..... A63B 21/0442 482/99
2016/0082301 A1 * 3/2016 Carter ..... A63B 21/068 482/99
2017/0100622 A1 4/2017 Wall
2017/0216649 A1 * 8/2017 Lalaoua ..... A63B 21/0407
2018/0242746 A1 * 8/2018 Lawson ..... A47C 1/12
2019/0126122 A1 * 5/2019 Vester ..... A63B 21/4029
2019/0329086 A1 * 10/2019 Rindfleisch ..... A63B 21/4033

* cited by examiner

ARM CHAIR EXERCISE APPARATUS

CROSS REFERENCE TO RELATED APPLICATIONS

This application claims the benefit of priority of U.S. Provisional Patent Application Ser. No. 62/925,164, filed Oct. 23, 2019, having the same title, the content of which is incorporated by reference in its entirety.

BACKGROUND OF THE DISCLOSURE

The present disclosure is directed to exercise equipment and more particularly to an improved Pilates arm chair exercise apparatus.

The Pilates arm chair is an exercise apparatus first developed by Joseph H. Pilates in the last century. This arm chair is essentially an inclined seat with a back angled at about 90 degrees from the seat surface, with elastic spring members fastened to a back extension positioned about 2 feet behind the top of the back of the chair. Each spring member has a hand grip attached to its distal end so that a user sitting on the arm chair seat can grasp one of the hand grips in each hand and perform various great circle arm exercises while maintaining a neutral central core body alignment.

SUMMARY OF THE DISCLOSURE

An exercise apparatus in accordance with the present disclosure is a modified version of such an arm chair exercise apparatus that has three distinct back positions. The arm chair includes a base configured to rest on a horizontal floor surface, a rectangular seat, a pair of spaced apart trapezoidal shaped upright frame sides, a front upright end wall beneath and supporting a front end of the seat, a seat back pivotally supported from the frame sides behind the seat, and a seat cross member beneath the rear edge of the seat fastened to the frame sides.

A chair exercise apparatus in accordance with the present disclosure may be viewed as including a rectangular base, a rectangular seat fastened to the base, a back fastened to two parallel back support members each pivotally fastened to the base, an elongated resistance member support spaced from each of the back support members and pivotally attached to a rear portion of the base, and a removable support block configured to engage slots in the rectangular base to limit rotation of the back between a first position having an angle of about 90 degrees with respect to the seat and a second position having an angle of about 80 degrees with respect to the seat. The base has a pair of upright side walls supporting the seat, each side wall having one of the slots therein for receiving one end of the removable support block. The base preferably includes a rear brace plate extending between the side walls and spaced from the seat and the back support members, and a rear seat support plate extends between the side walls beneath a rear edge of the seat.

One of the back support members and one of the elongated resistance member supports are each pivotally fastened to one of the upright side walls. Each side wall has one of the slots therein for receiving one end of the removable support block. A rigid lateral brace plate is fastened behind and spaced from the seat extending between the upright side walls behind each of the slots. The base also has a rear seat support plate extending between the side walls beneath a rear edge of the seat. Each of the slots extends down along the inside surface of the side wall parallel to the rigid lateral brace plate. Each of the back support members engage the removable support block in the slots to hold the back in the first position. The back may be rotated to the second position when the removable support block is removed from the slots. In addition the back may be tilted rearward to a third reclined position when the removable support block is removed. The base further includes a rear support plate extending between the side walls beneath a rear edge of the seat and the back support members engage the rear support plate to limit forward rotation of the back to the second position.

The apparatus in accordance with the present disclosure may alternatively be viewed as a chair exercise apparatus including a rectangular base having a pair of upright trapezoidal side walls, a rectangular seat fastened to the base, a back fastened to two parallel back support members each pivotally fastened to one of the side walls of the base, an elongated resistance member support spaced from each of the back support members pivotally attached to a rear portion of the base, and a removable support block configured to engage slots in the side walls of the rectangular base to limit rotation of the back between a first position having an angle of about 90 degrees with respect to the seat and a second position having an angle of about 80 degrees with respect to the seat. The apparatus may also include a rigid lateral brace plate behind and spaced from the seat extending between the upright side walls behind each of the slots. The base further may include a rear seat support plate extending between the upright side walls beneath a rear edge of the seat.

Each of the slots extends downward along an inner surface the side wall parallel to the rigid lateral brace plate. Preferably one slot has a stepped cross-sectional shape. Preferably only one end of the removable support block member has a tongue shape complementary to the stepped shape of the one of the slots. The removable support block member has opposite ends and a recess adjacent each end to receive a lower end of one of the back support members when the back is in the first or the second position. Finally, the back may be rotated rearward to a third position when the removable support block member is removed. In this third position, the lower ends of the back support members engage portions of the rear seat support plate to prevent further reclining or rotation of the seat back. In any one of the first, second and third positions, a user grasps handles each connected to an elastic resistance member such as a coil spring fastened to the resistance member support member spaced behind the back support member, and then the user performs exercises such as great circles, etc.

These and other features of the present disclosure will become more apparent from a reading of the following description taken in conjunction with the drawing figures.

DETAILED DESCRIPTION

Figure 1:
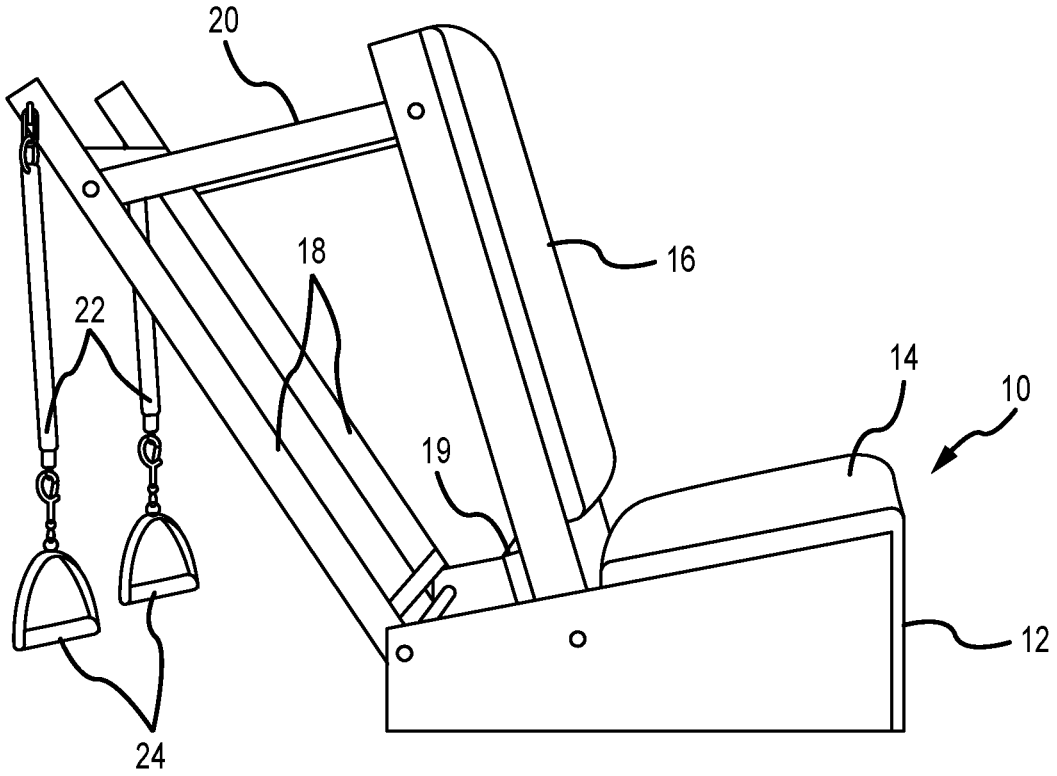
FIG.1 PRIOR ART
FIG. 1 is a perspective view of a prior art Pilates arm chair exercise apparatus.

A conventional prior art Pilates arm chair is shown in FIG. 1. The chair 10 has a generally rectangular base 12 configured to rest on a horizontal floor. The upper surface of the base 12 is slanted and carries a seat cushion 14. Pivotally mounted in the base is a back 16. A pair of spaced spring support members 18 are pivotally mounted to a rear corner of the base 12. The upper ends of each of the spring support members 18 is spaced from the back 16 by a pair of struts 20 that are pivotally fastened to both the back 16 and the spring support members 18. The back 16 is generally supported in a first position at about 90 degrees from the seat 14 by abutting against a brace 19 fastened across the base 12 behind the back 16. The back 16 may be tilted forward about 10 degrees to a second angled position. A user sits on the seat 14 and grasps one of the hand grips 24 attached to distal ends of springs 22, and then performs various arm exercises, such as great circles, while sitting upright against the back 16, or bent forward while sitting on the seat 14.

Figure 2:
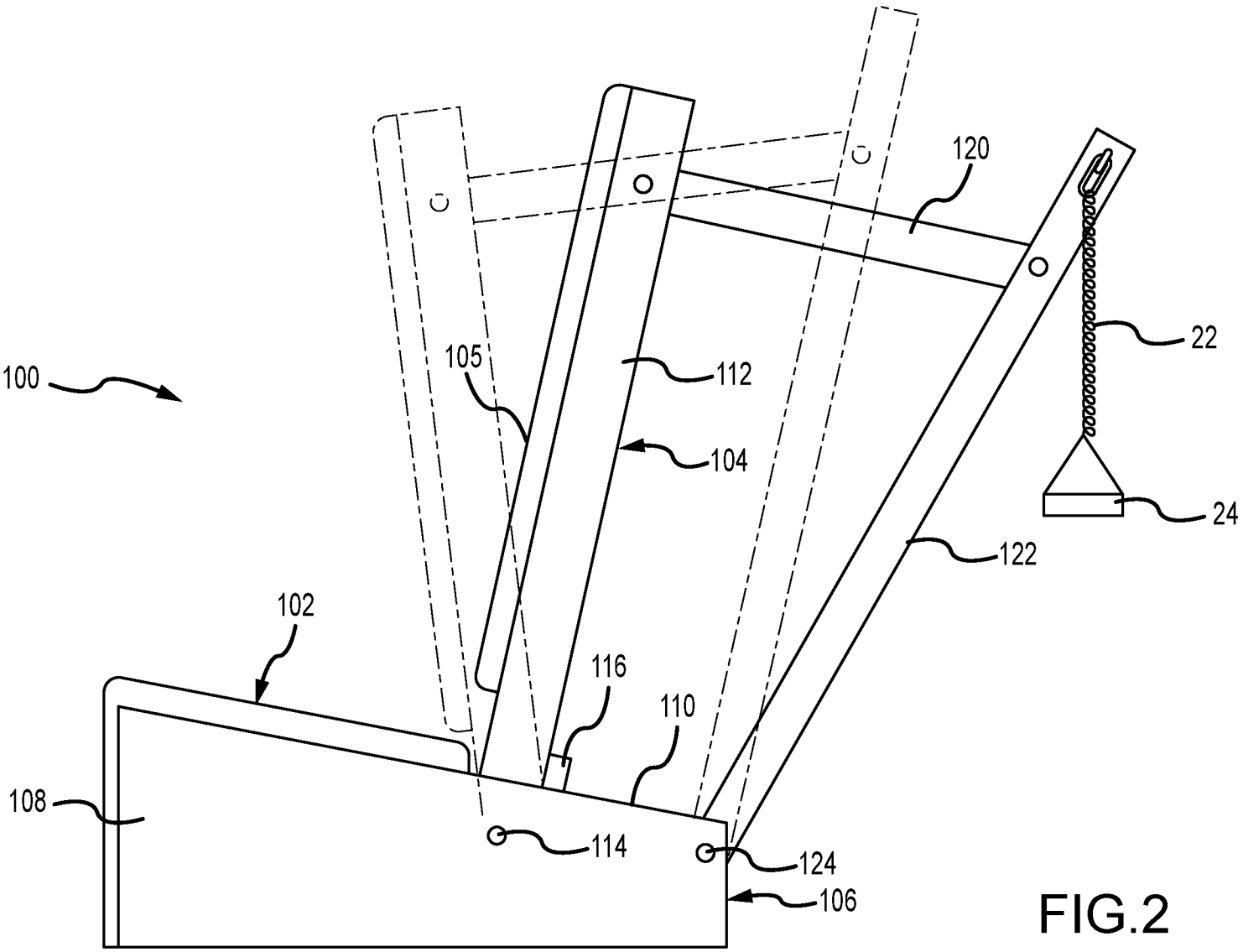
FIG. 2 is a left side view of an arm chair exercise apparatus in accordance with the present disclosure in an upright first position, with a forward second position shown in dashed lines.

An improved version of the Pilates chair arm exercise apparatus 100 in accordance with the present disclosure is shown in a side view in FIG. 2. The apparatus 100 is shown in the normal first position with the seat 102 and back 104 at about a 90 degree angle. The second position is shown in dashed lines, with the back 104 rotated forward about 10 degrees. The apparatus 100 has a rectangular base 106 configured to rest on a horizontal floor. The base 106 includes two trapezoidal shaped upright side walls 108 arranged to support the seat 102 fastened along their upper edge 110. The back 104 is formed by a rectangular cushion 105 fastened to two, parallel, elongated back support members 112 each having a proximal end fastened at a pivot 114 to the inside of one of the side walls 108. The distal end of each support member 112 is pivotally connected to one end of a strut 120 which has its other end pivotally fastened to a spring support member 122. This spring support member 122 has its lower end pivotally fastened to a pivot 124 in the upper rear corner of the upright side wall 108. Each upright side wall is rigidly spaced apart, in part, by a lateral brace plate 126 (visible in FIG. 4) forming part of the base 106 spaced behind the seat 102.

Figure 3:
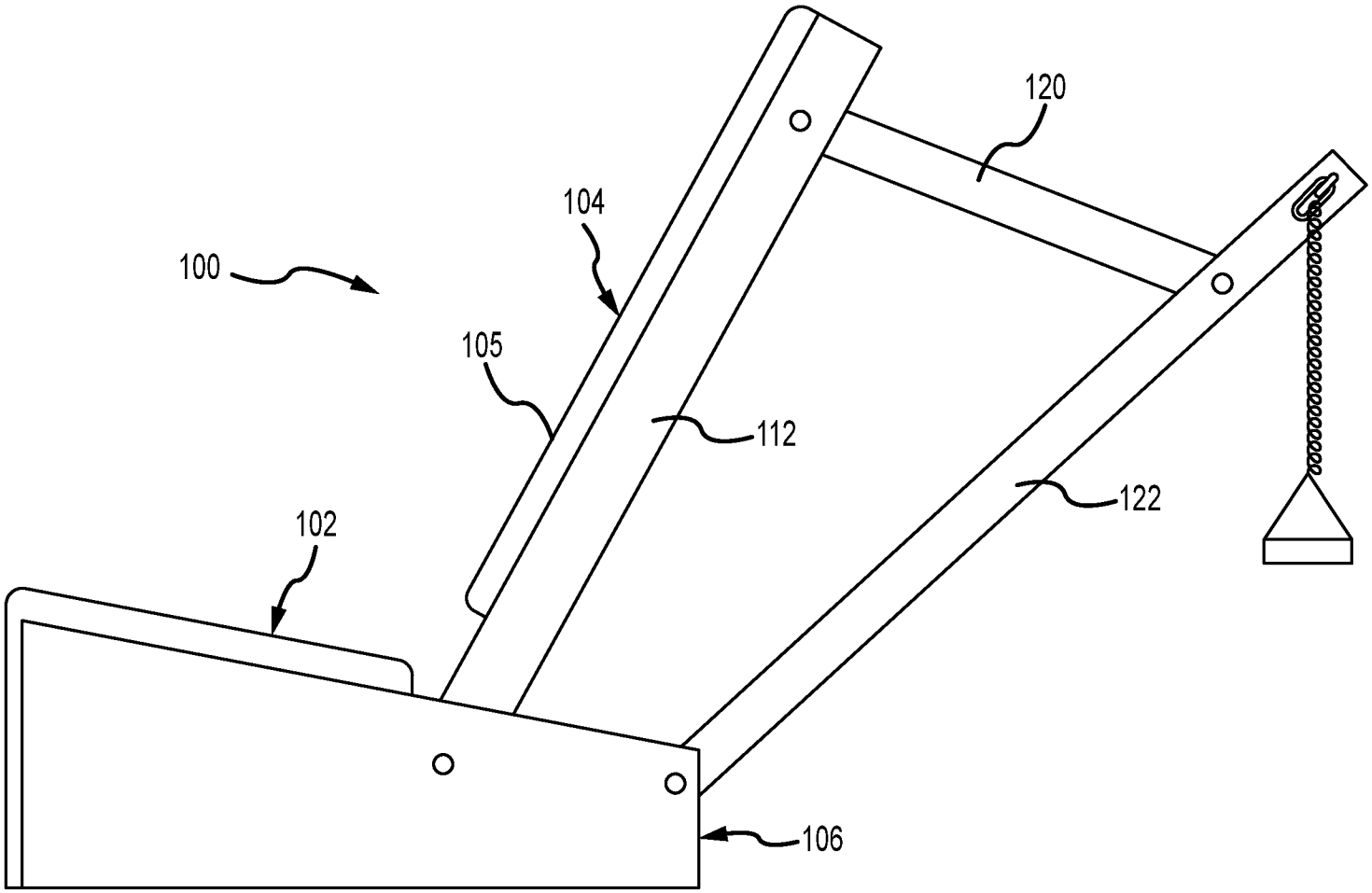
FIG. 3 is left side view of the exercise apparatus shown in FIG. 2 in a third, reclined, position.
Figure 4:
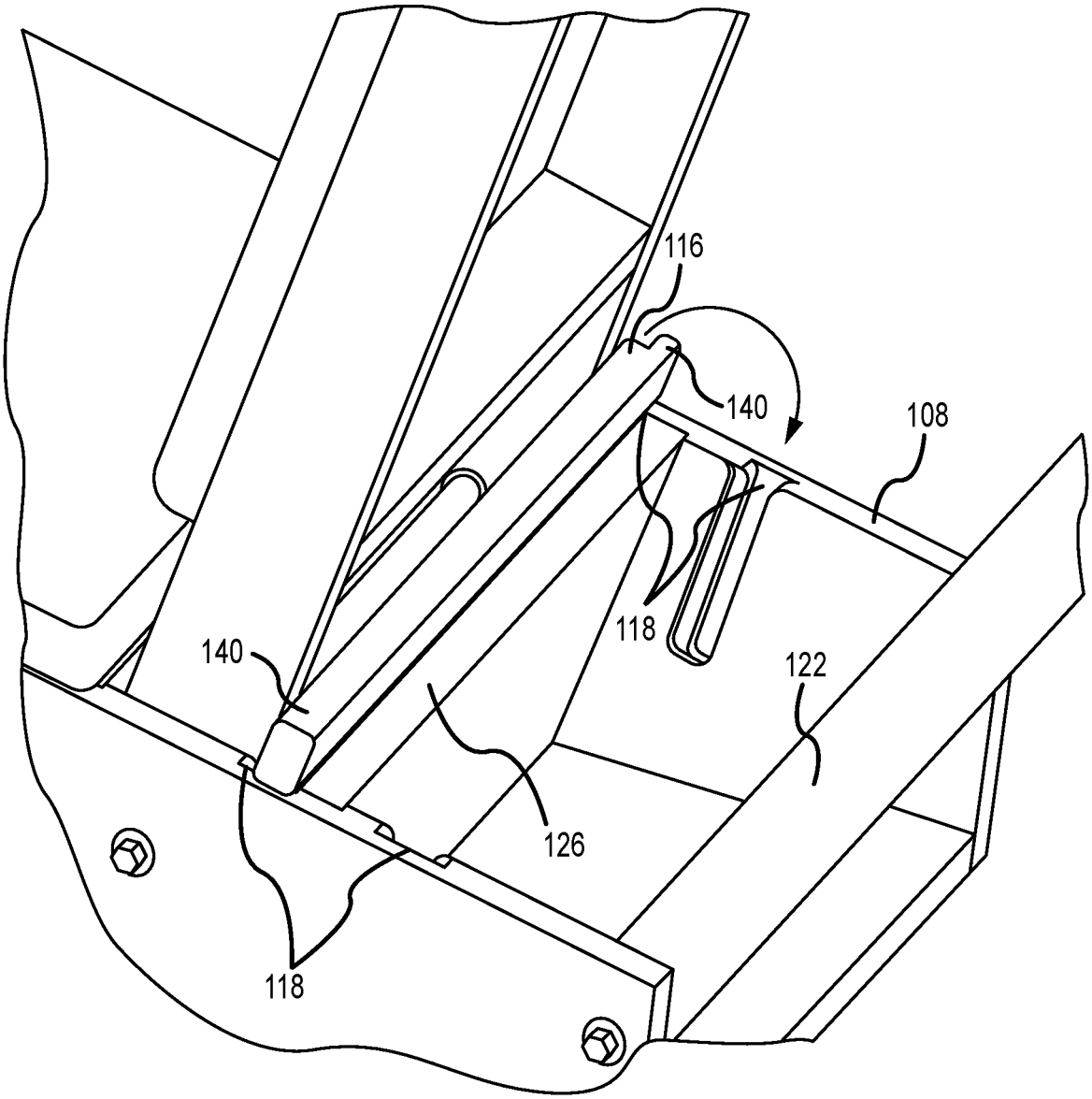
FIG. 4 is a close-up perspective view of the chair shown in FIG. 2 showing the removable back brace installed and the back in the upright first position.
Figure 9:
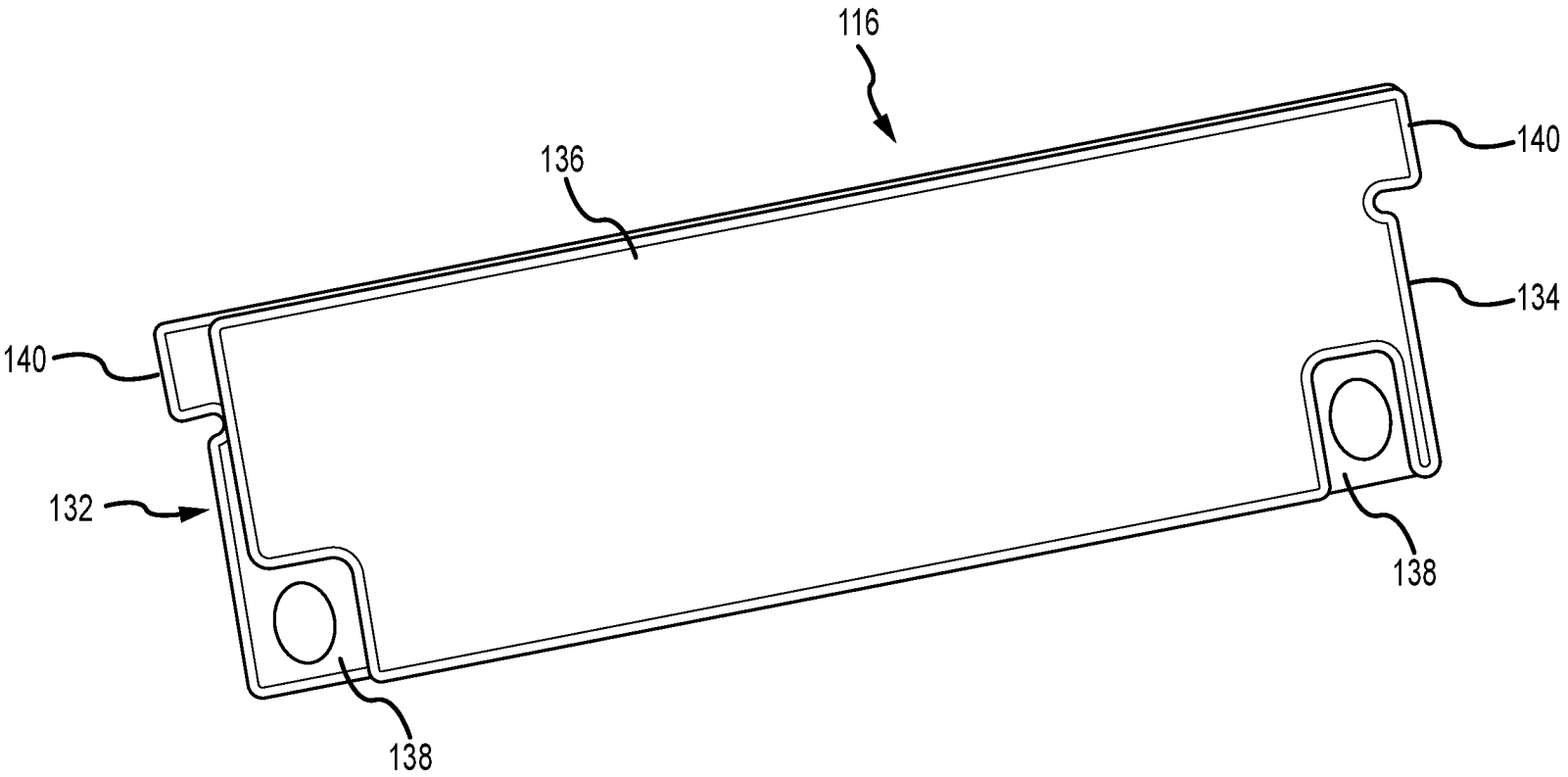
FIG. 9 is a separate perspective view of the removable back brace.

A generally rectangular removable support block member 116, separately shown in a perspective front view in FIG. 9, fits in slots 118 in the left and right side walls 108 of the base 106 in front of the brace plate 126 as shown in FIG. 4 to maintain the back 104 in the first position shown in FIG. 2. When the support block member 116 is removed from the slots 118, The back 104 tilts back to a reclined third position as shown in FIG. 3. In this third position shown in FIG. 3, the lower end of each of the back support members 112 abuts against a stop 128 formed by an angled portion of a rear seat support brace 130 rigidly fastened between the vertical sides 108 beneath the rear edge of the seat 102. This configuration is best shown in FIG. 5.

Figure 5:
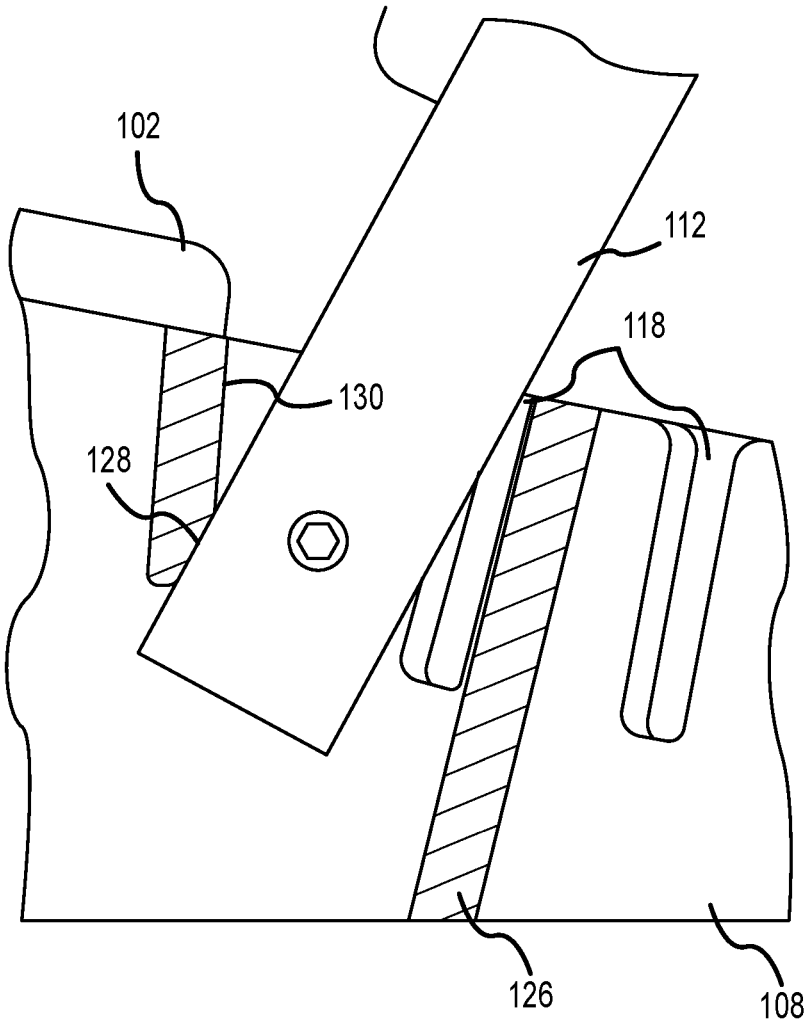
FIG. 5 is a vertical sectional view of the exercise apparatus with the back brace removed showing the back in the reclined third position shown in FIG. 3.
Figure 7:
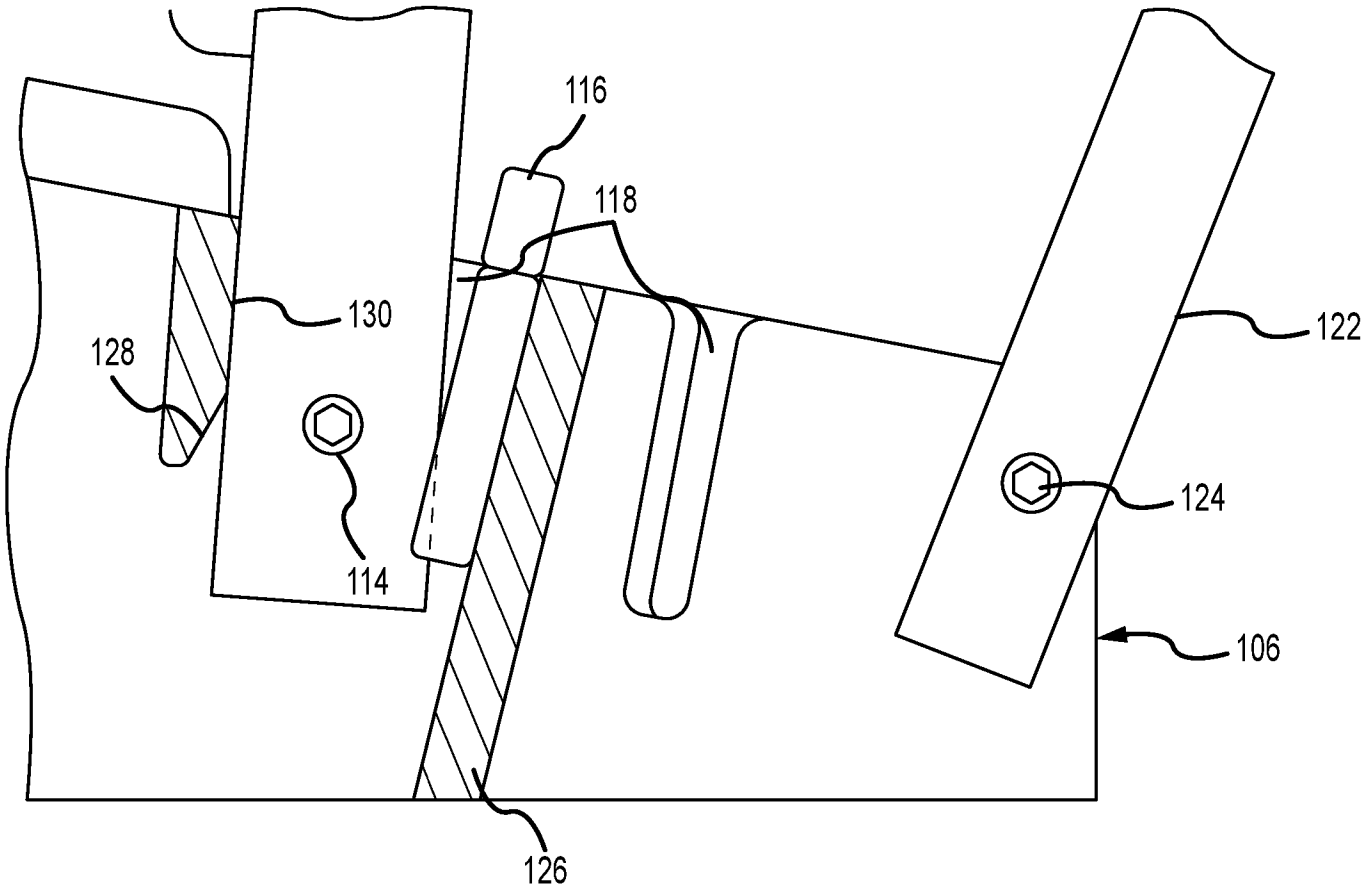
FIG. 7 is a vertical sectional view as in FIG. 6 showing the back tilted forward to the second position.
Figure 8:
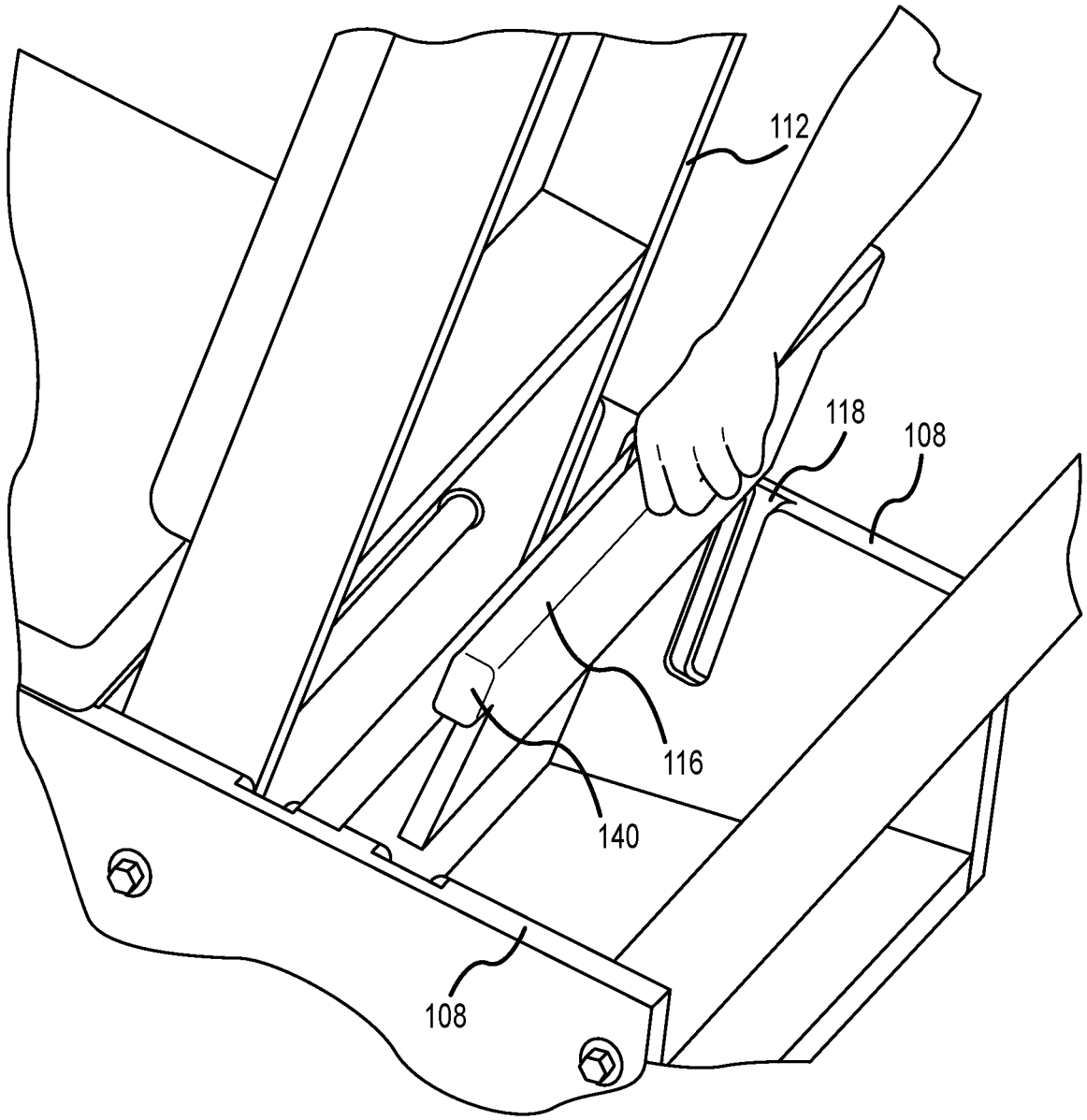
FIG. 8 is a close-up of the exercise apparatus showing removal of the back brace to its storage slot position while the apparatus is used in the reclined third position shown in FIG. 5

In FIG. 5, the configuration of the right side slot 118 can readily be seen as having a stepped shape. The removable support block member 116, separately shown in FIG. 9, has its right end 132 formed into a complementary shaped stepped tongue to fit down into the stepped slot 118 in the right side wall 108. The corresponding slot 118 in the left side wall 108 is a simple rectangular cross section slot. Correspondingly the left end 134 of the block member 116 has a complementarily shaped straight shape with no stepped tongue. This ensures that the removable block member 116 can only be inserted into the slots 118 with its front side 136 facing the back 104. The removable block member 116 has two recesses 138 in the front side 136 adjacent each end 132 and 134. These recesses 138 accommodates the lower ends of the back support members 112 when the back 104 is rotated forward to the second position as shown by the dashed lines in FIG. 2. At the same time, the forward edge of the back support members 112 abut parallel against the rear seat support brace 130 as shown in FIG. 7. The rear set of slots 118 are provided for optional storage of the block member 116 when the apparatus 100 is placed in the third, reclined position.

Figure 6:
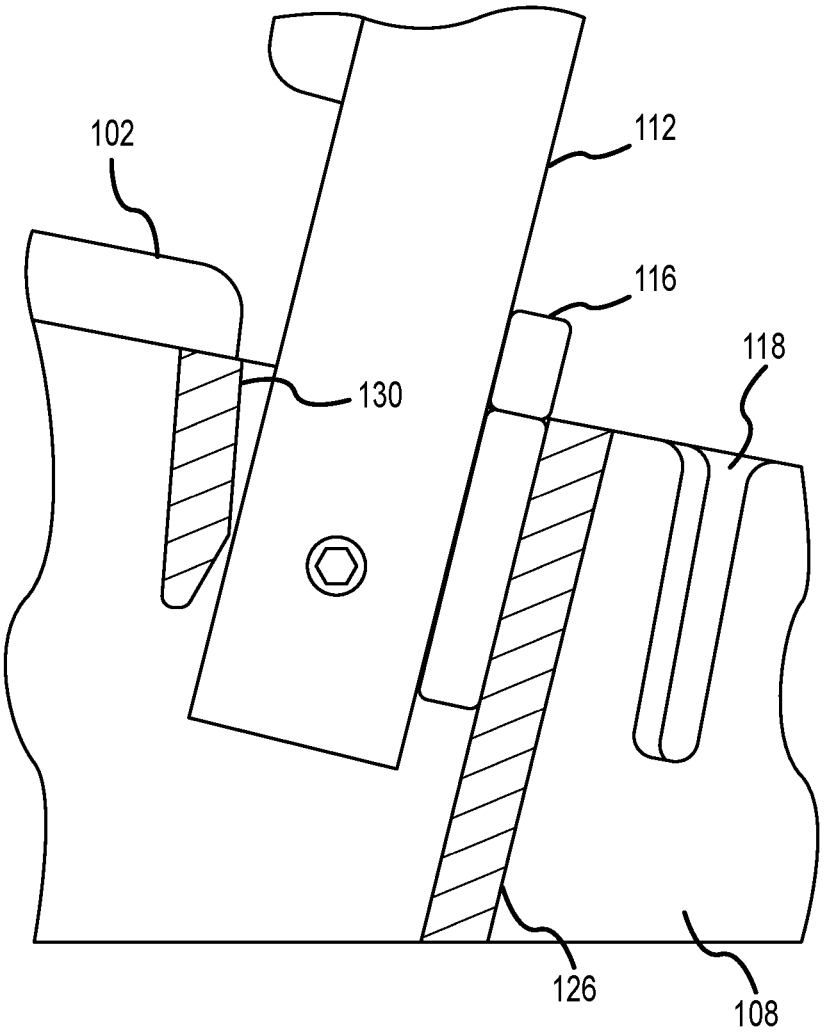
FIG. 6 is a vertical sectional view of the exercise apparatus with the back in the upright or first position.

FIG. 6 shows the back support member 112 in the first position, held in place by the support block member 116. The upper portion of the block member 116 forms tabs 140 at each corner that rest on top of the side wall 108 of the base 106.

Different spring sets may also be used. Alternatively, elastic cords may be utilized. Further, eye bolts may be fastened at various positions along outer sides of the spring support members 122 to provide different anchor points for springs or elastic cords to provide different levels of resistance during arm exercise. All such changes, alternatives and equivalents in accordance with the features and benefits described herein, are within the scope of the present disclosure. Any or all of such changes and alternatives may be introduced without departing from the spirit and broad scope of this disclosure.

The invention claimed is:

1. A chair exercise apparatus comprising:

a base;

a seat fastened to the base;

a back fastened to two parallel back support members each pivotally fastened to the base;

an elongated resistance member support spaced from each of the two parallel back support members and pivotally attached to a rear portion of the base; and a removable support block configured to engage slots in the base to limit rotation of the back between a first position having an angle of 90 degrees with respect to the seat and a second position having an angle of 80 degrees with respect to the seat, wherein the removable support block has opposite ends and a recess adjacent each end to receive a lower end of one of the two parallel back support members when the back is in the second position.

2. The apparatus according to claim 1 wherein the base further comprises a pair of upright side walls supporting the seat, each of the pair of side walls having one of the slots therein for receiving one end of the removable support block, and a rigid lateral brace plate behind and spaced from the seat extending between the pair of upright side walls behind each of the slots.

3. The exercise apparatus according to claim 2 wherein the base further comprises a rear seat support plate extending between the pair of upright side walls beneath a rear edge of the seat.

4. The exercise apparatus according to claim 3 wherein each of the slots extends parallel to the rigid lateral brace plate.

5. The exercise apparatus according to claim 2 wherein the back is configured to be rotated to the second position when the removable support block is removed from the slots.

6. The exercise apparatus according to claim 5 wherein the base further comprises a rear support plate extending between the side walls beneath a rear edge of the seat and the back support members engage the rear support plate to limit rotation of the back to the second position.

7. The exercise apparatus according to claim 2 wherein each of the back support members engage the removable support block in the slots to hold the back in the first position.

8. The exercise apparatus according to claim 1 wherein the base has a pair of upright side walls supporting the seat, each of the pair of upright side walls having one of the slots therein for receiving one end of the removable support block.

9. The exercise apparatus according to claim 8 further comprising the base including a rear brace plate extending between the pair of upright side walls and spaced from the seat and the two parallel back support members.

10. The apparatus of claim 8 further comprising a rear seat support plate extending between the pair of upright side walls beneath a rear edge of the seat.

11. The apparatus according to claim 8 wherein one end of one of the two parallel back support members and one end of the elongated resistance member support are each pivotally fastened to one of the pair of upright side walls.

12. A chair exercise apparatus comprising:

a base having a pair of upright trapezoidal side walls;

a seat fastened to the base;

a back fastened to two parallel back support members each pivotally fastened to one of the pair of upright trapezoidal side walls of the base;

an elongated resistance member support spaced from each of the two parallel back support members pivotally attached to a rear portion of the base; and a removable support block configured to engage slots in the pair of upright trapezoidal side walls of the base to limit rotation of the back between a first position having an angle of 90 degrees with respect to the seat and a second position having an angle of 80 degrees with respect to the seat, wherein the removable support block has opposite ends and a recess adjacent each end to receive a lower end of one of the two parallel back support members when the back is in the second position.

13. The apparatus according to claim 12 further comprising a rigid lateral brace plate behind and spaced from the seat extending between the pair of upright trapezoidal side walls behind each of the slots.

14. The exercise apparatus according to claim 13 wherein the base further comprises a rear seat support plate extending between the pair of upright trapezoidal side walls beneath a rear edge of the seat.

15. The exercise apparatus according to claim 14 wherein each of the slots extends parallel to the rigid lateral brace plate.

16. The exercise apparatus according to claim 14 wherein the back is configured to be rotated rearward to a third position when the removable support block is removed, the two parallel back support members engaging the rear seat support plate in the third position.

17. The exercise apparatus according to claim 12 wherein one of the slots has a stepped cross sectional shape.

18. The exercise apparatus according to claim 17 wherein only one end of the removable support block has a tongue shape complementary to the stepped cross-sectional shape of the one of the slots.

19. The exercise apparatus according to claim 12 wherein each end of the removable support block has an upper corner tab for engaging a top edge of the base.

* * * * *